US006679736B2

(12) United States Patent
Saka

(10) Patent No.: US 6,679,736 B2
(45) Date of Patent: Jan. 20, 2004

(54) TERMINAL FITTING AND A CONNECTOR

(75) Inventor: Yukinori Saka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 19 days.

(21) Appl. No.: 10/114,543

(22) Filed: Apr. 1, 2002

(65) Prior Publication Data

US 2002/0146943 A1 Oct. 10, 2002

(30) Foreign Application Priority Data

Apr. 4, 2001 (JP) ..... 2001-105504

(51) Int. Cl.[7] ..... H01R 13/432
(52) U.S. Cl. ..... 439/748
(58) Field of Search ..... 439/748, 852, 439/862, 595, 752

(56) References Cited

U.S. PATENT DOCUMENTS 5,624,289 A 4/1997 Kourimsky et al. ..... 439/852
5,664,972 A * 9/1997 Zinn et al. ..... 439/839

* cited by examiner

*Primary Examiner*—P. Austin Bradley
*Assistant Examiner*—Ann M. McCamey
(74) *Attorney, Agent, or Firm*—Gerald E. Hespos; Anthony J. Casella

(57) ABSTRACT

A terminal fitting (1) has a main body (9) and a shell (10) for covering the main body (9). The shell (10) has locks (19) that are cut and bent from the remainder of the shell (10). Protection walls (21) for protecting the locks (19) are formed behind the locks (19). The protection walls (21) have substantially the same width as the locks (19). Thus, an area of an entrance of the terminal fitting (1) into a connector housing (2) is small.

14 Claims, 6 Drawing Sheets

TERMINAL FITTING AND A CONNECTOR

BACKGROUND OF THE INVENTION

1. Field of the Invention

The present invention relates to a terminal fitting and to a connector provided therewith.

2. Description of the Related Art

U.S. Pat. No. 5,624,289 discloses a terminal fitting that can be inserted into a connector housing. A metal lock is formed integrally on the terminal fitting and engages a step formed in the connector housing to lock the terminal fitting in the housing.

FIG. 6 herein shows a similar arrangement with a metal lock 100 formed unwarily in the upper surface of a terminal fitting 101 by cutting and bending. The metal lock 100 is resiliently deformable and cantilevers back with respect to an inserting direction of the terminal fitting 101 into the housing. The lock 100 can get caught by a wire or can be stuck by external matter, and may undergo a plastic deformation if there is no protection. Accordingly, stabilizers 102 have been provided near the lock 100 to protect the lock 100 from plastic deformation.

However, the stabilizers 102 extend longitudinally adjacent opposite lateral edges of the lock 100. Thus, a terminal insertion opening of the housing needs to be dimensioned to avoid interference with the stabilizers 102. FIG. 7 shows an area necessary to pass the terminal fitting 101 by phantom line for a round terminal insertion opening 105. It can be understood that the cross section of the terminal insertion opening 105 is fairly large to avoid interference with the stabilizers 102. This results in a larger housing.

The stabilizers 102 are formed simultaneously with the lock 100 by utilizing an opening made by forming the lock 100. However, the formation of the stabilizers 102 and the lock 100 creates a large opening 103 that exposes the inside of the terminal fitting 101. Thus, a resilient tongue 104 inside in the terminal fitting 101 is exposed to potential damage.

In view of the above problems, an object of the present invention is to allow only a small area of passage for a terminal fitting.

SUMMARY OF THE INVENTION

The invention is directed to a terminal fitting that can be inserted into a connector housing. The terminal fitting has a main body and one or more resilient contact pieces in the main body for contacting a mating terminal fitting. At least one lock is cantilevered rearwardly and outwardly from a side surface of the main body, and at least one protection wall projects from the main body at a location behind the free end of the lock. Accordingly, damage to the lock can be mitigated. Further, the protection wall is no wider than the lock. Thus, an area of passage of the terminal fitting into the connector housing can be minimized. This enables an open area of a terminal insertion opening in the connector housing to be small, thus contributing to a smaller connector.

The stabilizers used in the prior art terminal fitting to protect the lock extend along the edges of the side surface of the terminal fitting at the opposite lateral ends and a large opening is required in the side surface to form the stabilizers. However, the protection wall of the subject invention is behind the lock and has substantially the same width as the lock. Thus, an opening made in the surface by the formation of the protection wall is not as large as the opening made by the formation of the stabilizers in the prior art terminal fitting. The smaller opening can enhance the strength of the terminal fitting and protects the contact portion inside the terminal fitting.

The cantilevered lock may be formed by cutting and bending a portion of the side surface of the main body so that the lock projects back with respect to the inserting direction. The protection wall may be formed by bending an edge of an opening that is made during the formation of the lock, and preferably the edge that faces the free end of the lock.

The main body preferably is substantially box-shaped.

The terminal fitting preferably comprises two locks and two protection walls that are formed substantially symmetrically, on the two surfaces of the main body that substantially facing each other.

The stabilizers that prevent an upside-down insertion of the terminal fitting also have protected the lock in the prior art terminal fitting. However, upside-down insertion of the terminal fitting cannot be avoided if the terminal fitting has the protection wall instead of the stabilizers. Thus, the terminal fitting can be mounted properly regardless of the vertical orientation of the terminal fitting if the locks and the protection walls are substantially symmetrical.

According to a further preferred embodiment of the invention, the main body has a shell integrally mountable thereto, and the lock and/or the protection wall are provided on the shell. The shell preferably is made from a material different from the main body, and the main body preferably has at least one touching portion for contacting the shell.

The invention also is directed to a connector with a housing that has at least one cavity, and terminal fittings accommodated in the respective cavities. The lock preferably cooperates with a locking projection inside the cavity.

The locking projection preferably is between the lock. And the protection wall when the terminal fitting is inserted properly. The locking projection then preferably contacts the lock and the protection wall.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
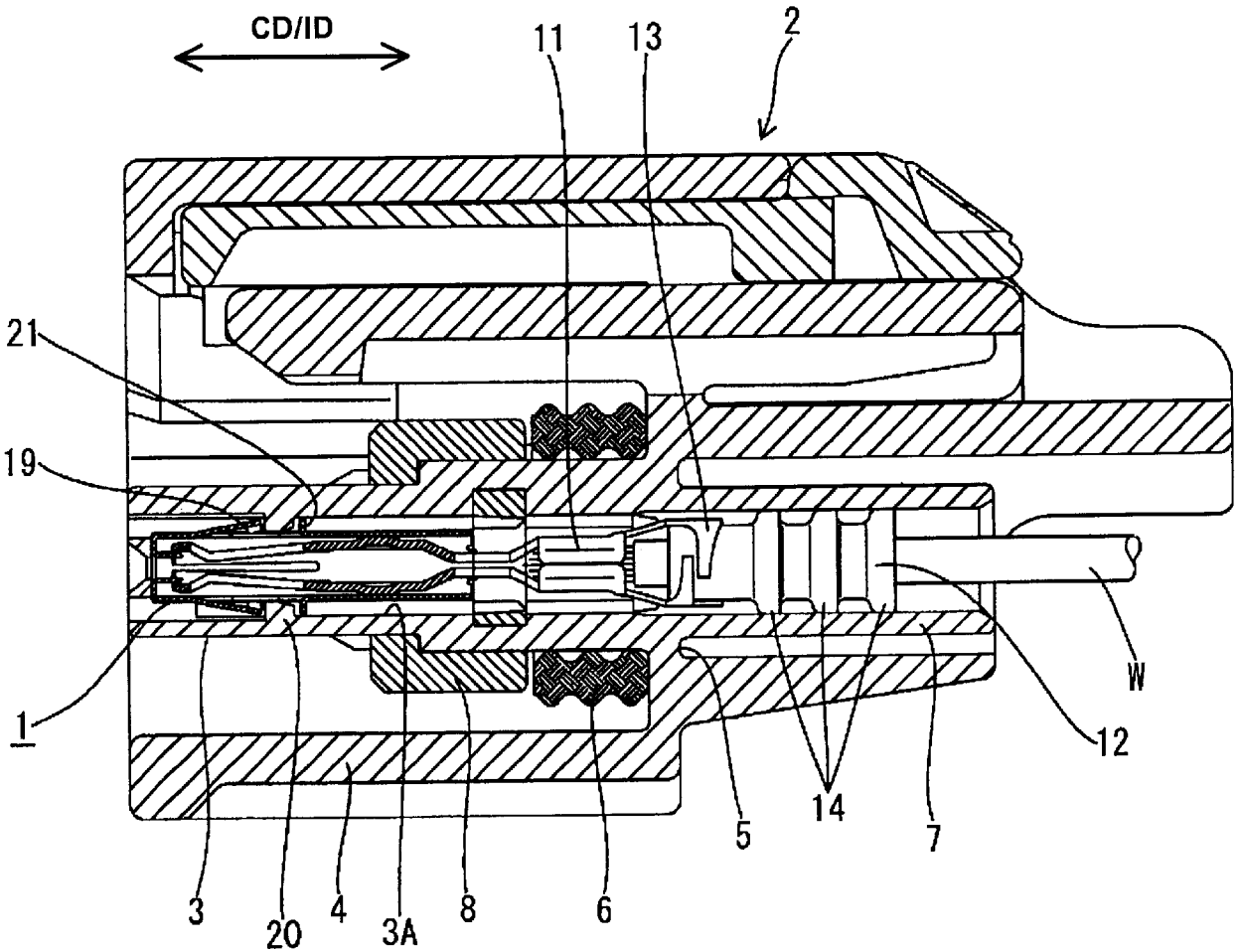
FIG. 1 is a section showing a state where a female terminal fitting is mounted into a female connector housing.
Figure 2:
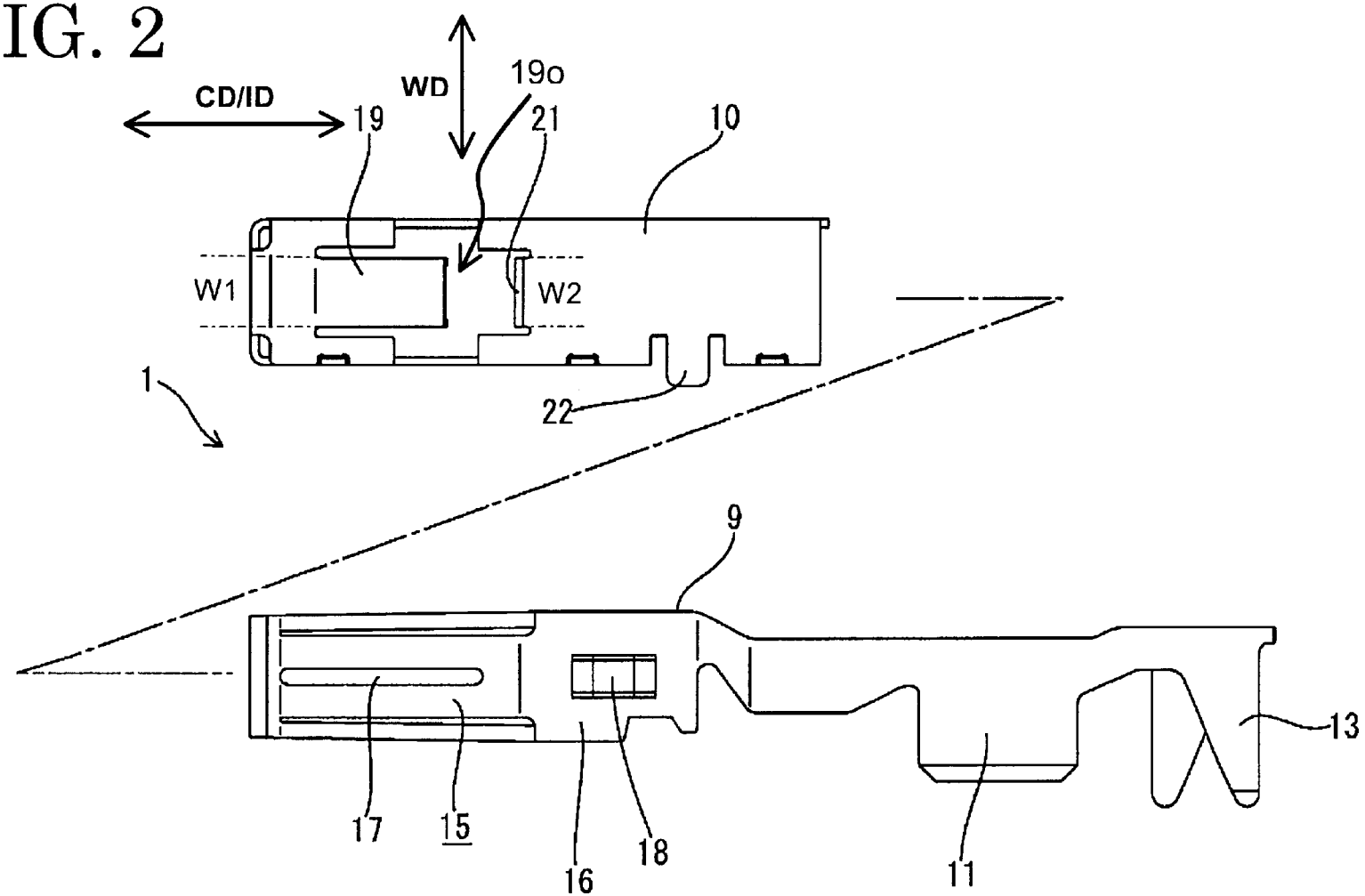
FIG. 2 is an exploded side view of the female terminal fitting.
Figure 3:
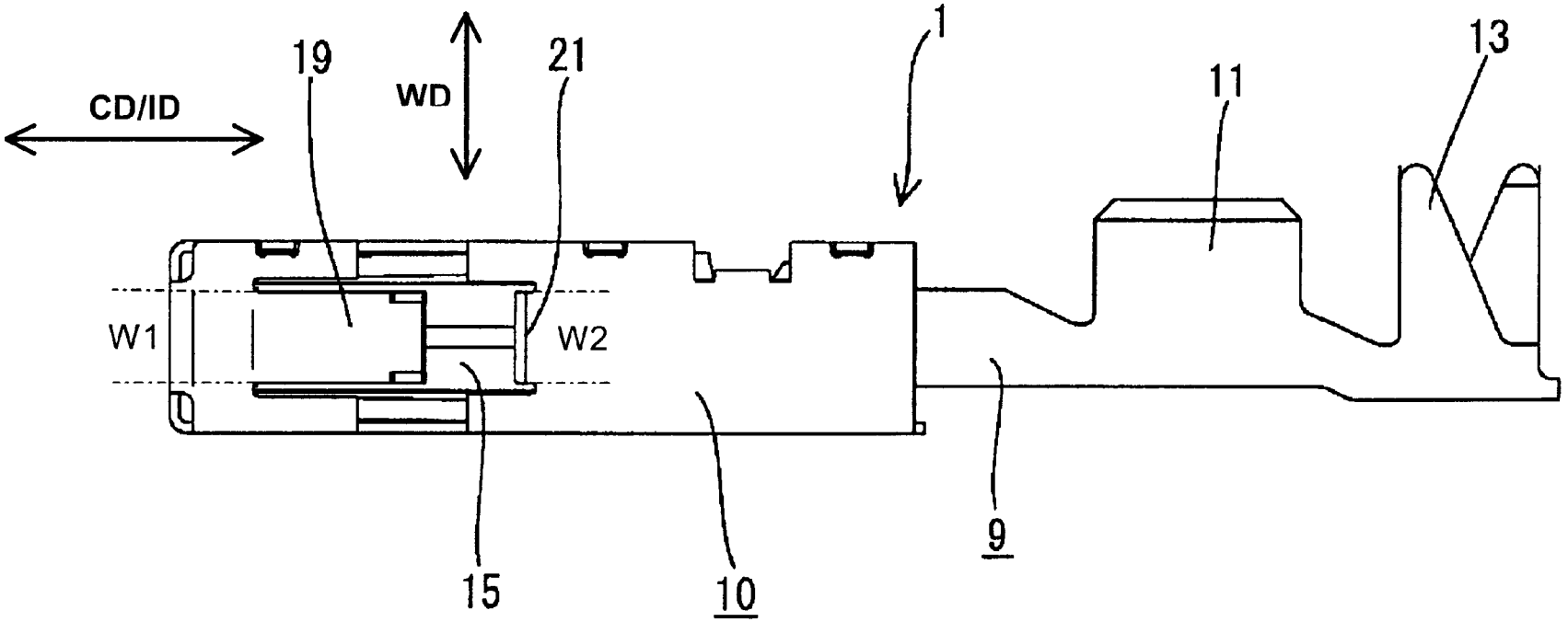
FIG. 3 is a side view of the female terminal fitting.
Figure 4:
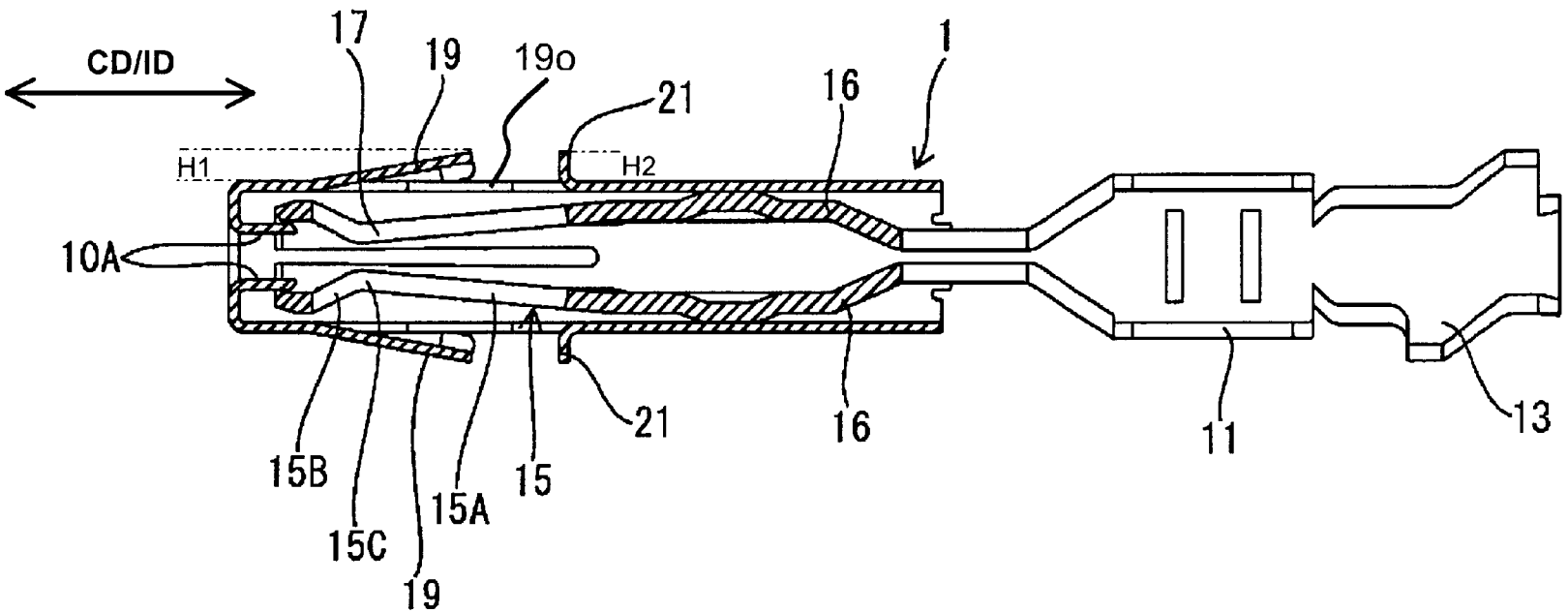
FIG. 4 is a section of the female terminal fitting.
Figure 5:
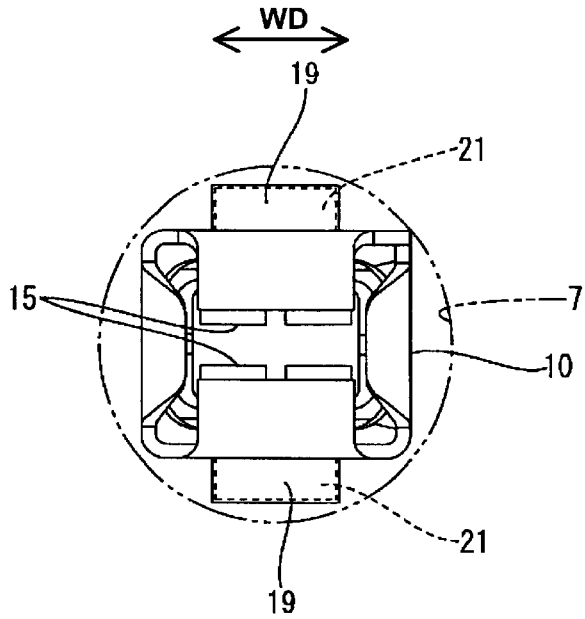
FIG. 5 is a front view showing the female terminal inserted in a sealing tube.
Figure 6:
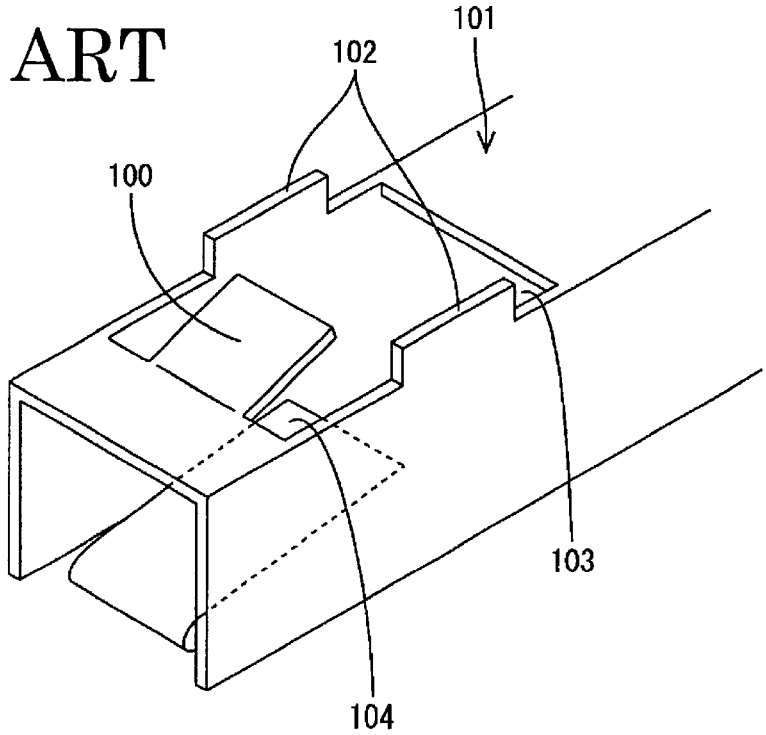
FIG. 6 PRIOR ART
FIG. 6 is a perspective view of a prior art terminal fitting.
Figure 7:
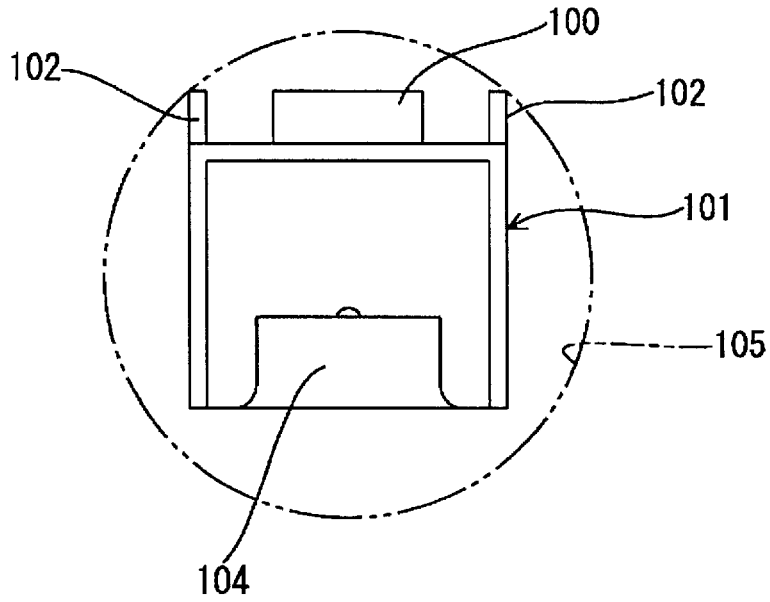
FIG. 7 PRIOR ART
FIG. 7 is a front view showing a problem of the prior art terminal fitting when it is inserted.

A female terminal fitting in accordance with the invention is identified by the numeral 1 in FIGS. 1 to 5. The terminal fitting 1 is configured to be mounted in a housing 2 along an insertion direction ID. The housing 2 is formed integrally or unwarily from a synthetic resin and is provided internally with a terminal accommodating portion 3 that has a cavity 3A for accommodating the female terminal fitting 1 in the inserting direction ID. The housing 2 also has a receptacle 4 that surrounds the terminal accommodating portion 3. The inside of the receptacle 4 is divided into a front section and a rear section by a partition wall 5 on the outer surface of the terminal accommodating portion 3. A male connector housing is fit table into a space in the front section. A resilient sealing ring 6, which preferably is made of rubber, is mounted on the terminal accommodating portion 3 before the partition wall 5 to provide sealing between the female and male connector housings when the mating connector housing is fitted substantially along a connecting direction CD. On the other hand, a rear portion of the terminal accommodating portion 3 behind the partition wall 5 has a hollow cylindrical shape and functions as a sealing tube 7.

A retainer 8 is provided for locking the terminal fitting 1. The retainer 8 is not related directly to the present invention, and only a brief description is given. The retainer 8 is mounted to cross the terminal accommodating portion 3 through an opening (not shown) in the receptacle 4. After mounting, the retainer 8 can lock the sealing ring 6 as well as the female terminal fitting 1 by a portion that enters the cavity 3A.

The female terminal fitting 1 is connectable with a male terminal fitting in the male connector housing when the male and female connector housings are connected with each other. In this embodiment, a main body 9 and a shell 10 are produced separately and are assembled into the female terminal fitting 1.

The main body 9 is formed into a long narrow shape by bending an electrically conductive metallic plate that has been stamped or cut out into a specified shape. A wire barrel 11 and an insulation barrel 13 are formed on the rear half of the main body 9. The wire barrel 11 is configured for crimped connection with a core of a wire W and the insulation barrel 13 is configured for crimped connection with a rubber plug 12 mounted on the wire W. As shown in FIG. 1, annular lips 14 project from the outer circumferential surface of the rubber plug 12. The lips 14 closely contact the inner surface of the sealing tube 7 to provide a sealing function or watertightness.

Transversely or vertically spaced resilient contact pieces 15 are provided at the front half of the main body 9 for contacting a tab of the male terminal fitting. The resilient contact pieces 15 extend forwardly from supporting walls 16 in the middle of the main body 9 and continue toward the space where the mating connector is to be arranged. Each resilient contact piece 15 is formed with a narrow slit 17 that extends longitudinally along the connecting direction CD. When viewed from side, each resilient contact piece 15 has a long substantially straight base 15A that extends obliquely inward with respect to the connecting direction CD or inserting direction ID. A short bent end 15B extends obliquely out from the front end of the base 15A, and a contact 15C defines an obtuse angle intersection between the base 15A and the bent end 15B, and is disposed for contacting the male terminal fitting. The tip of the bent end 15B is bent inwardly. Thus, the resilient contact pieces 15 can be deformed outwardly about the rear ends of the bases 15A in a direction substantially normal to the connecting direction CD to widen space between the bent ends 15B and between the contacts 15C. The space between the upper and lower contacts 15C in a free state, where the resilient contact pieces 15 are not in contact with the male terminal fitting, is smaller than a vertical thickness of the tab of the male terminal fitting. The supporting walls 16 are partly embossed to form touching portions 18 that bulge out and into contact with the inner surfaces of the shell 10.

The shell 10 is formed from a conductive or nonconductive plate of a metallic or non-metallic material that is stamped or cut out into a specified shape. The plate then is bent into a long narrow tubular configuration. The shell 10 can be at least partly fit on the main body 9 from the front to assemble the female terminal fitting 1. The inner surfaces of the upper and lower walls of the shell 10 contact the touching portions 18 of the main body 9 as described above. Thus, the main body 9 and the shell 10 can be positioned transversely with respect to each other without shaking. Fastening pieces 22 are formed near the rear end of the shell 10. The fastening pieces 22 are crimped, bent or folded into connection with portions of the supports 16 of the main body 9 to assemble the main body 9 and the shell 10 into a single unit.

The edges of the front surface of the shell 10 are substantially in the form of a rectangular tube and are folded back inwardly to enable insertion of the tab of the male terminal fitting. The folded front edges face each other transversely and have their leading ends 10A engaged with the tips of the bent ends 15B to hold the spacing between the contacts 15C in the free state at a specified distance. A space is provided between the resilient contact pieces 15 and the inner surfaces of the shell 10. The space is sufficient to permit the resilient deformation of the two resilient contact pieces 15 when the tab of the male terminal fitting is inserted.

Two locks 19 are formed symmetrically in the upper and lower surfaces of the shell 10 for locking the terminal fitting 1 in the cavity 3A. Each lock 19 is cantilevered obliquely out, and is formed by making a U-shaped cut and bending about a transverse axis at a position near the leading end of the shell 10 to form an opening 19*o*. The locks 19 are deflectable toward and away from the upper and lower surfaces of the terminal fitting 1. Insertion of the female terminal fitting 1 into the cavity 3A brings the locks 19 into contact with locking projections 20 that project from the inner bottom surface and the ceiling surface of the cavity 3A. Thus, the locks 19 deflect inwardly. However, the locks 19 are restored resiliently after passing the locking projections 20. Thus, the leading ends of the locks 19 engage the locking projections 20 to lock the female terminal fitting 1.

The formation of each lock 19 creates an opening in the shell 10, and a protection wall 21 projects transversely from an edge of the opening that faces the leading end of the respective lock 19. The protection walls 21 have a width W2 along the widthwise direction WD that is equal to or less than the width W1 of the locks 19. Additionally, the projecting distance H2 of each lock 19 is substantially equal to the projecting height H1 of the leading ends of the locks 19 in a transverse direction. The space between the leading ends of the locks 19 and the protection walls 21 is set such that the protection walls 21 are substantially in contact with the surfaces of the locking projections 20 opposite from the surfaces of the locking projections 20 that contact the locks 19 (FIG. 1).

The female terminal fitting 1 is inserted through the sealing tube 7 and into the cavity 3A of the connector housing 2. Thus, the locks 19 of the terminal fitting 1 move into engagement with the locking projections 20 in the cavity 3A and are deformed inwardly as the terminal fitting 1 advances in the cavity 3A. However, the locks 19 are restored resiliently after passing the locking projections 20.

Thus, the leading ends of the locks 19 engage the locking projections 20 to achieve partial locking of the female terminal fitting 1 at the proper position in the cavity 3A. The retainer 8 then is mounted on the terminal accommodating portion 3 through the unillustrated opening in the receptacle 4. As a result, part of the retainer 8 enters the cavity 3A to engage the female terminal fitting 1. Thus, the female terminal fitting 1 is locked fully by the retainer 8 and by the locks 19. The protection walls 21 have substantially the same width and projecting height as the locks 19 and are formed behind the locks 19. Accordingly, the protection walls 21 protect the locks 19 from contact by external matter even when the female terminal fitting 1 is left alone. As a result, plastic or unwanted deformation of the locks 19 can be avoided.

The sealing tube 7 must have a cross section sufficiently large to avoid interference with the protection walls 21 during insertion of the terminal fitting 1. In this embodiment, the protections walls 21 do not bulge out laterally significantly beyond the locks 19. Additionally, the protection walls 21 extend along the width direction AD a distance We comparable to the width We of the locks 19. Thus, the sealing tube 7 is allowed to have a small cross section, and the protection walls 21 contribute to making the entire housing 2 smaller.

A wide opening typically is made in a surface of a terminal fitting where a stabilizer is formed because the cut and bent stabilizer extends to the lateral edges of the surface and because the stabilizer of a prior art terminal fitting must have a sufficient longitudinal dimension to guide the insertion of the terminal fitting. Thus, the inside of the prior art terminal fitting is exposed through this wide opening, and the contact portion inside the terminal fitting is subject to possible damage. However, in this embodiment, the protection walls 21 are near the locks 19 and are narrow. Accordingly, no large opening is made during formation of the protection walls 21. Therefore, the inside of the terminal is exposed less and the contact portion can be protected.

Further, in this embodiment, the locks 19 and the protection walls 21 are symmetrically provided on the sides of the female terminal fitting 1 because no stabilizer is formed. Therefore, the female terminal fitting 1 also can be inserted upside down.

The present invention is not limited to the above described and illustrated embodiment. For example, following embodiments also are embraced by the technical scope of the present invention as defined in the claims. Beside the following embodiments, various changes can be made without departing from the scope and spirit of the present invention as defined in the claims.

Although the female terminal fitting has a two-piece construction, with a separate main body 9 and shell 10 in the foregoing embodiment, it may have a one-piece construction. Also, the present invention may be applied to male terminal fittings.

Although the protection walls 21 are formed utilizing the openings made upon forming the locks 19 in the foregoing embodiment, they may be formed individually and separately from the locks 19.

Although the present invention is applied to a watertight connector in the foregoing embodiment, application to connectors is not restricted.

What is claimed is:

1. A terminal fitting insertable along an insertion direction into a connector housing, comprising:

a shell having opposite front and rear ends and at least one side surface, an opening formed in the side surface at a location spaced intermediate the front and rear ends;

at least one lock cantilevered from the side surface of the shell at the opening and projecting backward with respect to the inserting direction, the lock having a width and having a free end spaced outwardly from the side surface by a selected distance; and at least one protection wall bent up from an edge of the opening behind the free end of the lock with respect to the inserting direction and projecting from the side surface a distance that is substantially equal to the distance, the protection wall further having a width no greater than the width of the lock, such that the protection wall protects the lock.

2. The terminal fitting of claim 1, wherein the lock is formed by cutting and bending a portion of the side surface of the shell at the opening to project backward with respect to the inserting direction.

3. The terminal fitting of claim 1, wherein the shell is substantially box-shaped.

4. The terminal fitting of claim 1, wherein the protection wall is formed by bending an edge adjacent the opening facing the free end of the lock.

5. The terminal fitting of claim 1, comprising two locks and two protection walls substantially symmetrically formed, respectively, on two opposed surfaces of the shell.

6. The terminal fitting of claim 1, further comprising at least one resilient contact piece on a main body inside the shell for contacting a mating terminal fitting.

7. The terminal fitting of claim 6, wherein the shell is mounted to the main body, the lock and the protection wall being formed on the shell at locations aligned with the resilient contact piece.

8. The terminal fitting of claim 7, wherein the main body is provided with at least one touching portion for contacting the shell.

9. The terminal fitting of claim 8, wherein the shell and the main body are formed from different types of material.

10. A connector, comprising:

a housing having at least one cavity extending along an insertion direction; and a terminal fitting configured for insertion into the housing along the insertion direction, the terminal fitting having a shell with at least one side surface and opposite front and rear ends, at least one lock cantilevered from the side surface of the shell and projecting backward with respect to the inserting direction, the lock having a width and having a free end spaced outwardly from the side surface by a selected distance, at least one protection wall formed behind the free end of the lock with respect to the inserting direction and forward of the rear end of the shell and projecting from the side surface a distance that is substantially equal to the distance, the protection wall further having a width no greater than the width of the lock, such that the protection wall protects the lock.

11. The connector of claim 10, wherein the lock engages a locking projection inside the cavity.

12. The connector of claim 11, wherein the locking projection is between the lock and the protection wall when the terminal fitting is inserted properly, such that the locking projection contacts both the lock and the protection wall.

13. A terminal fitting, comprising:

a main body having first and second resilient contact pieces for contacting a mating terminal;

a substantially rectangular tubular shell having opposite front and rear ends and opposed first and second sides extending between the ends, the shell being fit around at least a portion of the main body;

first and second resiliently deflectable locks having base ends on the respective first and second sides of the shell and free ends cantilevered obliquely outwardly and toward the rear end of the shell, such that the free end of each said lock is spaced outwardly from the respective side surface by a selected distance, each said lock having a width; and first and second protection walls formed on the respective first and second side walls at locations between the free end of the respective lock and the rear end of the shell and at locations aligned with the resilient contact pieces, each said protection wall projecting from the respective side surface a distance that is substantially equal to the selected distance, each said protection wall further having a width no greater than the width of the respective lock and being aligned with the respective lock, such that the protection walls protect the locks and the resilient contact pieces.

14. The terminal fitting of claim 13, wherein the locks and the protections walls are formed symmetrically on the respective sides.

* * * * *